United States Patent [19]

Combes et al.

[11] 4,408,892

[45] Oct. 11, 1983

[54] APPARATUS FOR INCREASING THE HOMOGENEITY OF A FLUID FLOW IN A PIPE

[75] Inventors: Gilles Combes, Grenoble; Raymond Kuntz, Saint Ismier, both of France

[73] Assignee: Societe Anonyme dite: Alsthom-Atlantique, Paris, France

[21] Appl. No.: 375,157

[22] Filed: May 5, 1982

[30] Foreign Application Priority Data

May 5, 1981 [FR] France ..... 81 08883

[51] Int. Cl.[3] ..... B01F 3/08; B01F 5/06

[52] U.S. Cl. ..... 366/337; 366/340; 138/42; 138/43

[58] Field of Search ..... 366/336, 337, 338, 340, 366/231, 240; 138/42, 43

[56] References Cited

U.S. PATENT DOCUMENTS

| | | | |
|---|---|---|---|
| 2,740,616 | 4/1956 | Walden | 366/336 |
| 2,747,844 | 5/1956 | Slayter | 366/336 X |
| 3,167,305 | 1/1965 | Backx et al. | 138/42 X |
| 3,190,618 | 6/1965 | Katzen | 366/337 |
| 3,219,483 | 11/1965 | Goos et al. | 366/337 X |
| 4,189,243 | 2/1980 | Black | 366/336 |

FOREIGN PATENT DOCUMENTS

| | | | |
|---|---|---|---|
| 2056871 | 3/1981 | United Kingdom | 366/337 |

*Primary Examiner*—Philip R. Coe
*Assistant Examiner*—Thomas W. Epting
*Attorney, Agent, or Firm*—Sughrue, Mion, Zinn, Macpeak and Seas

[57] ABSTRACT

Apparatus for increasing the homogeneity of the mixture of fluids, e.g. petroleum products flowing together in a pipe. The apparatus operates by dividing the flow into multiple converging jets and comprises a tubular body (10) for insertion in the pipe. The tubular body (10) houses a cylindrical sheath (9) inside which two plates (21, 22) provided with perforations (23) define two inlet chambers (25, 26) between which the flow is distributed. The space (33) between the plates is partitioned by a plurality of partitions (36) which are substantially perpendicular to the axis of the sheath so as to constitute outlet cells in which jets from the perforations of the plates converge. Said outlet cells have openings (38) formed in the sheath for the lateral removal of the fluids which mix therein.

7 Claims, 6 Drawing Figures

A
B
a1
a2
a3
2
3
9
10
11
12
13
14
15
16
17
21
22
24
31
34
36
38
41
51
52
61
71
III
IV

APPARATUS FOR INCREASING THE HOMOGENEITY OF A FLUID FLOW IN A PIPE

The present invention relates to apparatus for increasing the degree of homogeneity of a mixture of fluids flowing together in a pipe. Mixture is intended to mean the simultaneous presence of several fluids whether miscible or immiscible.

BACKGROUND OF THE INVENTION

The invention applies in particular to the homogenization of a mixture of water and liquid hydrocarbons flowing in a pipe; said homogenization is made necessary when it is required to measure accurately the quantity of water in the mixture.

It has already been recommended to divide the flow coming from upstream into a plurality of converging jets and to modify the value of the diameter of the jets.

The working principle of this type of apparatus is schematically illustrated in the accompanying FIG. 1. The apparatus includes a chamber with perforated walls 3 disposed inside a pipe 2 in which the fluids flow from an upstream end A to a downstream end B, with the jets such as a1 situated at the upstream end of the mixer being truly radial and therefore convergent.

However, at the downstream end of the mixer, the jets (a2, a3) are deflected by the longitudinal flow set up from the upstream end to the downstream end in the chamber 3.

The result of this is that the jets have a radial velocity component which becomes smaller the further the jet is situated downstream. Opposing jets no longer meet and the various substances do not mix properly as they should do.

Preferred embodiments of the invention provide apparatus for increasing the homegeneity of the mixture of two fluids founded on the same principle of dividing the fluids into converging jets, but having increased performance and improved operational security at all discharge rates of the flow in question.

SUMMARY OF THE INVENTION

The present invention provides apparatus for increasing the homegeneity of the mixture of fluids which flow in the same pipe, the apparatus operating by dividing the flow into multiple converging jets, wherein the apparatus comprises a tubular structure for insertion in a pipe, said tubular structure housing a cylindrical sheath and said sheath being fitted with two perforated plates that define two inlet chambers between which fluid flowing into the apparatus from the pipe is distributed, the space between the plates being partioned by a plurality of partitions which are substantially perpendicular to the axis of the sheath so as to constitute a plurality of outlet cells in which jets of fluid from the perforations through the plates converge, said cells having openings formed in the sheath for the lateral removal of the fluids which mix in the cells.

Advantageously, there is an angle of between 15° and 30° between the plates open towards the downstream end so as to make the longitudinal speeds in the chambers more uniform and to improve the flow near the plates.

In a preferred embodiment, the sheath is slidably disposed in a first pipe connected to the upstream pipe, a second pipe of larger diameter than the first pipe being fixed thereto and to the downstream pipe, the mixed fluids flowing in the zone lying between the sheath and the inner wall of the second pipe.

In a variant, the sheath has a sliding sleeve whose movement closes successively the openings in the sheath.

BRIEF DESCRIPTION OF THE DRAWINGS

The invention will be better understood from the following description of a preferred embodiment, with reference to the accompaying drawings in which.

MORE DETAILED DESCRIPTION

Figures 1, 2:
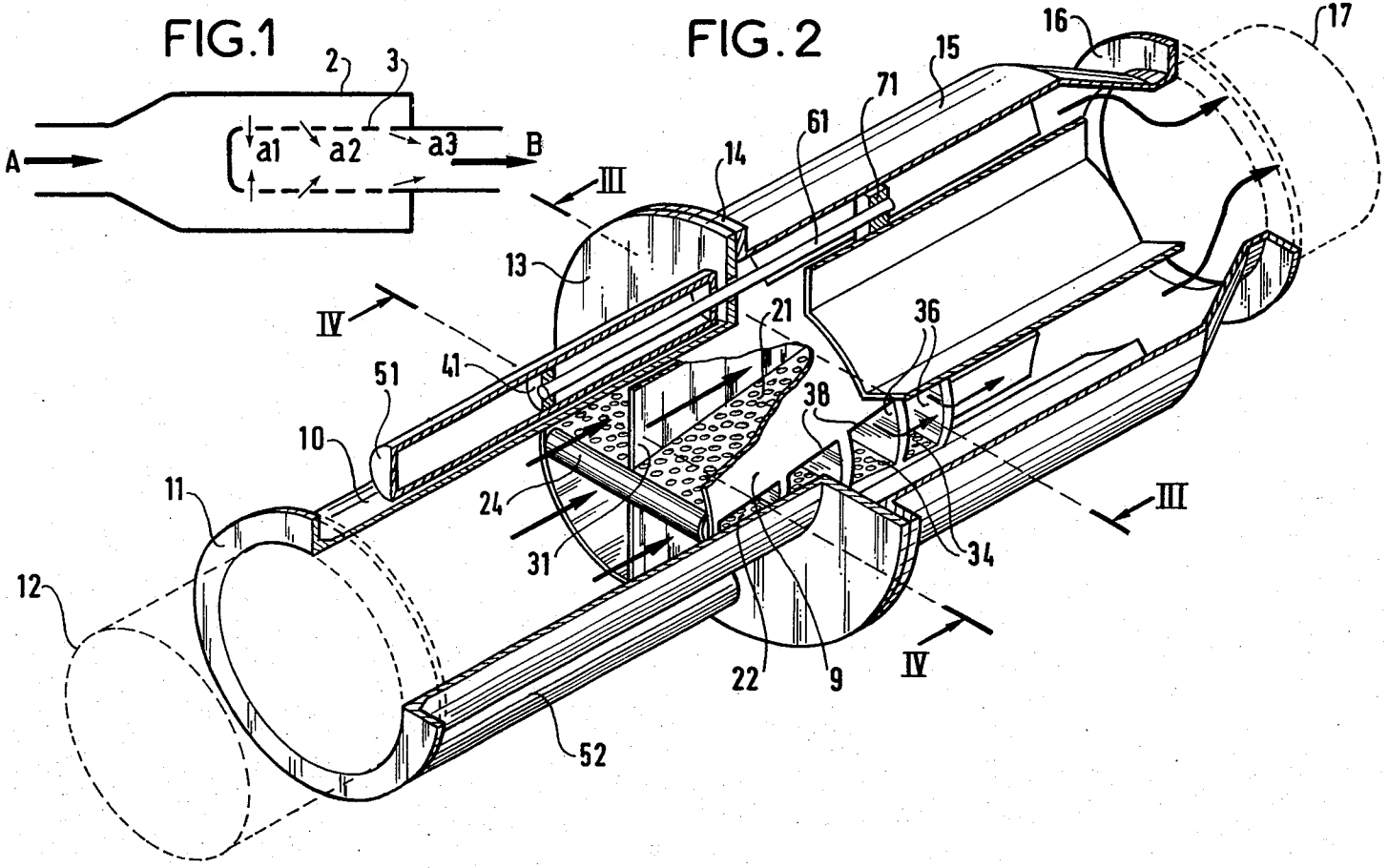
FIG. 1 is a diagram representative of the prior art.
FIG. 2 is a partially cut away perspective view of apparatus in accordance with the invention.

The apparatus illustrated in FIG. 2 includes an upstream tubular portion 10 connected by a flange 11 to an upstream pipe 12 partially illustrated by dashed lines and a downstream tubular portion 15 connected by a flange 16 to a downstream pipe 17 partially illustrated in dashed lines The aim of the apparatus is to intimately mix the fluids which arrive from upstream to obtain, downstream, a sufficiently homogenous and stable mixture, e.g. to make significant measurements of the transport concentration of one or several of the transported fluids.

The portions 10 and 15 are assembled to each other by flanges 13 and 14.

The apparatus comprises a cylindrical structure disposed inside the portions 10 and 15.

Figure 3:
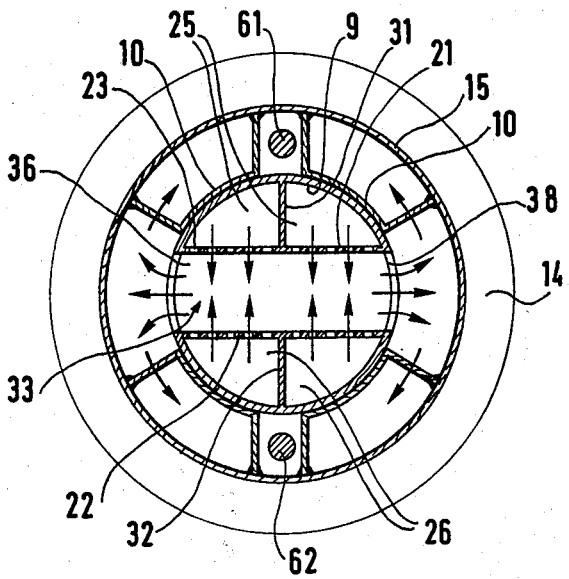
FIGS. 3 and 4 are cross-sections along lines III—III and IV—IV of FIG. 2.
Figure 4:
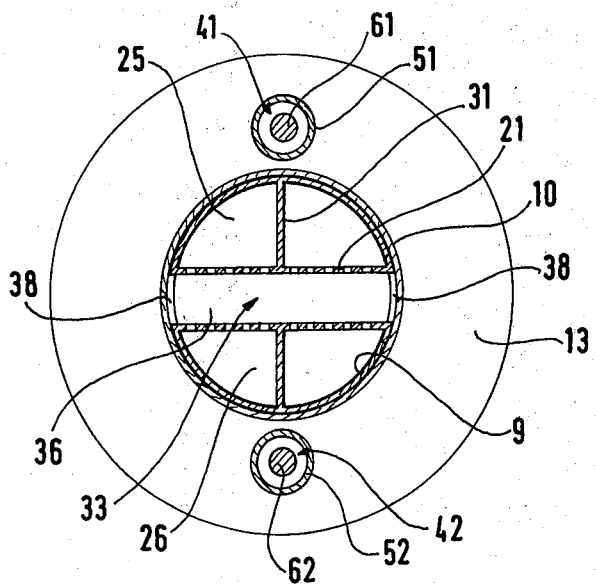

The cylindrical structure comprises a cylindrical sheath 9 closed at its downstream end and having a diameter smaller than that of the upstream tubular portion 10 so as to fit therein; two perforated plates or grates 21 and 22 are disposed inside the sheath and have holes 23; these two plates are connected together in a sealed manner at the downstream end of the sheath and are connected together at the upstream end either directly or by a deflecting plate 24. Said disposition forms two chambers 25 and 26 which separate the upstream flow into two parts. Then the fluids are divided into multiple opposed streams whose directions are indicated by arrows f1 in FIG. 3.

Optionally, the two upstream chambers above and below the perforated plates 21 and 22 can be divided by perpendicular partitions 31 and 32 which help to hold the plates in the sheath 9.

In the case illustrated by the figures, the perforated plates diverge towards the downstream end by an angle which lies between 15° and 30°.

Lastly, the space between the two perforated plates is divided up into a plurality of cells 34 delimited by the perforated plates 21 and 22 and by the partitions 36 perpendicular to the general axis of the sheath.

The jets f1 which converge towards the space 33 lying between the plates escape laterally through side openings 38 formed in the sheath 9. This disposition prevents the flow from modifying the vertical component of the speed of the jets f1 and the mixture is formed both near the downstream zones and near the upstream zones of the apparatus.

The structure which has just been defined may be slidable in the tubular portions, in which case, as in the figures, it is actuated by pistons 41 and 42 which slide in cylinders 51 and 52 disposed on either side of the pipe 10.

The rods 61, 62 of the pistons 41, 42 pass through the flanges 13 and 14 and end in studs 71,72 for fixing and guiding the sheath.

The sliding of the structure allows the flow rate to be adjusted by closing one or more cells 34.

In FIG. 2, it is observed that one and a half cells are shut.

Figure 5:
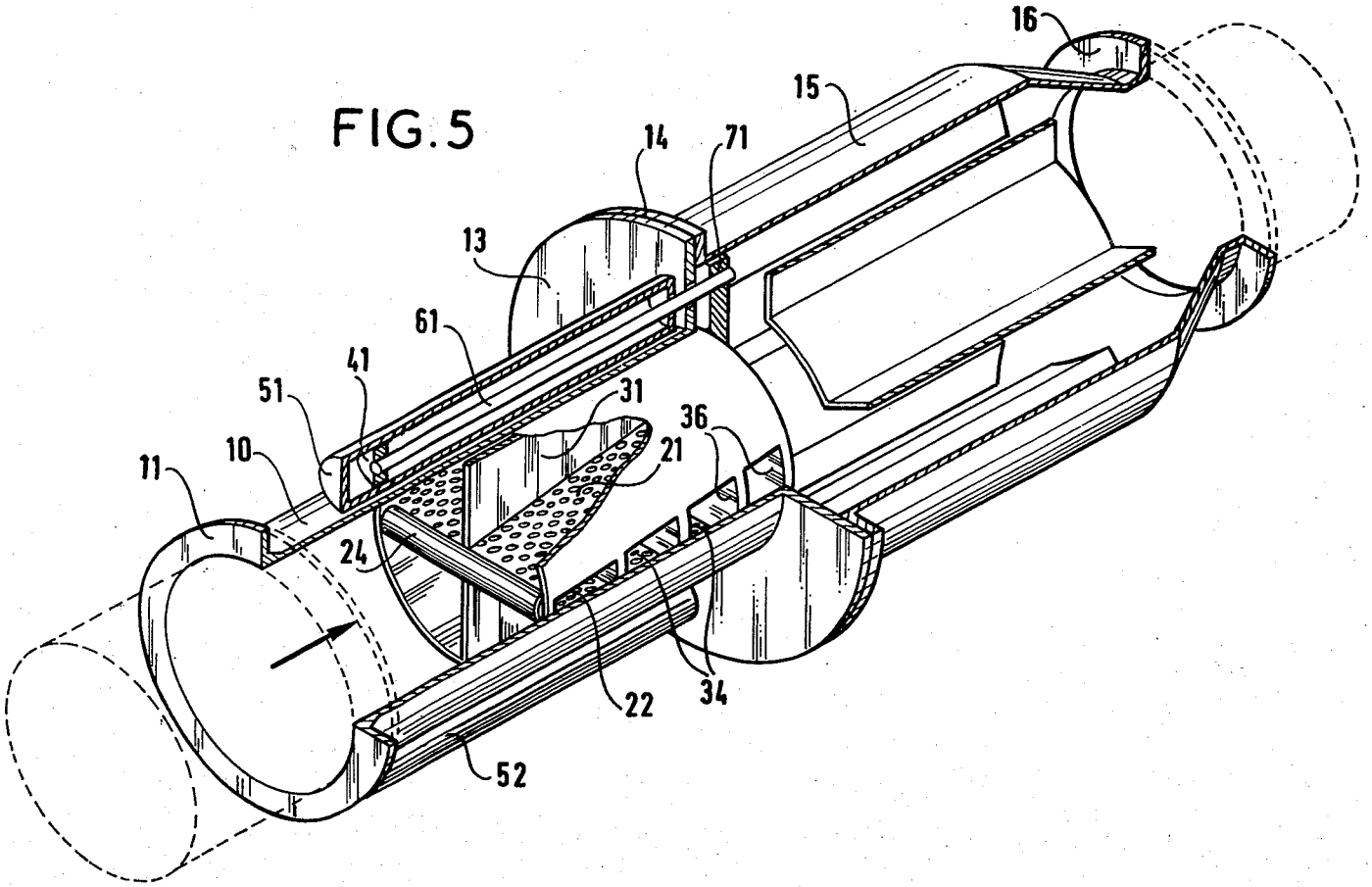
FIGS. 5 and 6 illustrate the same apparatus in different operating positions.

In FIG. 5, all the cells 34 are shut; the apparatus then acts as a closed valve.

Figure 6:
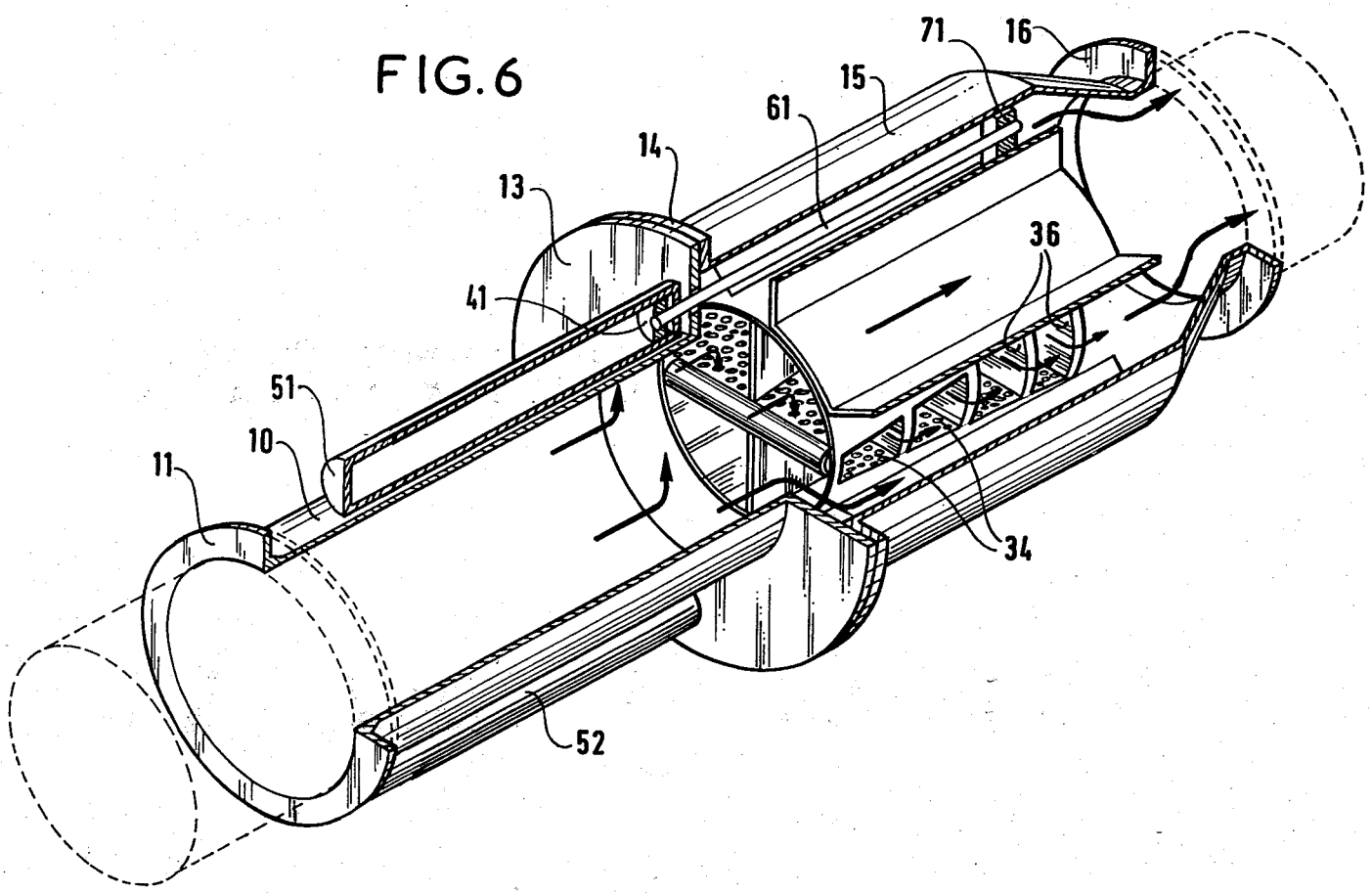

In FIG. 6, on the contrary, the moving structure is pushed back completely downstream; there are no appreciable eddy currents in the flow but there is no great loss of head.

In one variant, not illustrated, the sheath 9 can be stationary and the flow rate of the mixer can be adjusted by a sleeve which slides around the sheath.

The invention applies in particular to the mixture of petroleum products which flow in a pipe and which contain a proportion of water which it is necessary to measure accurately. Said measurement can be made only after homogenizing the mixture, e.g. by passing it through the apparatus in accordance with the invention.

We claim:

1. Apparatus for increasing the homogeneity of the mixture of fluids which flow in the same pipe, the apparatus operating by dividing the flow into multiple converging jets, wherein the apparatus comprises a tubular structure for coupling in a pipeline end for end between pipe sections, a cylindrical sheath housed in said tubular structure, said sheath being fitted with two diverging longitudinal perforated plates merging at their upstream ends so as to define two inlet chambers between which fluid flowing into the apparatus from the pipe is distributed, a plurality of partitions which are substantially perpendicular to the axis of the sheath partitioning the space between the plates so as to constitute a plurality of outlet cells in which jets of fluid from the perforations through the plates converge, and said sheath having openings formed therein laterally to each side thereof for the lateral removal of the fluids which mix in the cells.

2. Apparatus according to claim 1, wherein the divergence between said plates is at an angle of between 15° and 30°.

3. Apparatus according to either one of claims 1 and 2, wherein the chambers are each provided with a partition perpendicular to the plates and parallel to the axis of the sheath.

4. Apparatus according to claim 1, wherein the plates are connected together on the upstream side by a deflector plate.

5. Apparatus according to claim 1 or claim 4, wherein the sheath is slidably disposed in a first tubular portion connected to the upstream pipe section, a second tubular portion of larger diameter than the first pipe is fixed thereto and to the downstream pipe section, and wherein the mixed fluids flow in the zone lying between the sheath and the inner wall of the second tubular portion.

6. Apparatus according to claim 5, wherein a jack has a rod fixed by its first end to the sheath and provided at its second end with a piston which slides in a cylinder on the outside of the first tubular section and being fixedly connected to said sheath.

7. Apparatus according to claim 1 or claim 4, wherein the sheath includes a sliding sleeve whose movement closes successively the openings in the sheath.

* * * * *